US007744173B2

(12) United States Patent
Maglinger et al.

(10) Patent No.: US 7,744,173 B2
(45) Date of Patent: Jun. 29, 2010

(54) ICE BUCKET RETAINER FOR REFRIGERATOR

(75) Inventors: Frank Weston Maglinger, Evansville, IN (US); Martin Shawn Egan, Ballwin, IN (US); Aidan C. Kunkle, Evansville, IN (US); Richard Bruce Mills, Evansville, IN (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 11/411,168

(22) Filed: Apr. 25, 2006

(65) Prior Publication Data

US 2007/0245762 A1 Oct. 25, 2007

(51) Int. Cl.
*A47B 95/00* (2006.01)

(52) U.S. Cl. ..... 312/333; 312/308; 312/215; 312/220; 312/221; 312/404; 312/291; 312/293.1; 312/298; 312/301; 312/222; 312/402; 62/377; 62/344; 292/251.5

(58) Field of Classification Search ..... 62/344, 62/465, 466, 377; 312/404, 308, 215, 220, 312/221, 333, 291, 293.1, 298, 301, 222, 312/402; 292/251.5, DIG. 71
See application file for complete search history.

(56) References Cited

U.S. PATENT DOCUMENTS

| | | | | |
|---|---|---|---|---|
| 2,711,944 | A * | 6/1955 | Meek et. al. | 312/333 |
| 2,926,507 | A | 3/1960 | Ingolia | 62/377 |
| 2,967,407 | A * | 1/1961 | Melikian | 62/344 |
| 3,883,204 | A * | 5/1975 | Prada et al. | 312/273 |
| 4,087,140 | A * | 5/1978 | Linstromberg | 312/292 |
| D326,461 | S * | 5/1992 | Nakao et al. | D15/86 |
| 5,201,512 | A * | 4/1993 | Rabin | 271/164 |
| 5,899,083 | A | 5/1999 | Peterson et al. | 62/186 |
| 6,447,083 | B1 | 9/2002 | Chiapetta et al. | 312/404 |
| 6,582,038 | B2 | 6/2003 | Moreno-Olguin et al. | 312/405.1 |
| 6,745,578 | B2 * | 6/2004 | Collins et al. | 62/71 |
| 7,261,385 | B2 * | 8/2007 | Weinberger | 312/330.1 |
| 2006/0175842 | A1 * | 8/2006 | Saitoh et al. | 292/251.5 |

* cited by examiner

*Primary Examiner*—Frantz F. Jules
*Assistant Examiner*—Azim Rahim
(74) *Attorney, Agent, or Firm*—Kirk W. Goodwin; Greer, Burns & Crain

(57) ABSTRACT

A refrigerator is provided with a cabinet having a door that is openable by a user to provide access to a refrigeration compartment. A storage bin is located in the refrigeration compartment and accessible upon the opening of the cabinet door. A mounting system is arranged for the storage bin, supporting the storage bin for movement into and out of the refrigeration compartment. A latch is carried on the cabinet door to be selectively engaged by the user with a latch receiving portion of the storage bin. When the latch is engaged with the latch receiving portion, the storage bin will be pulled out of the refrigerator upon the opening of the cabinet door, and when the latch is disengaged from the latch receiving portion, the storage bin will remain in the refrigeration compartment, unless manually moved by the user.

28 Claims, 7 Drawing Sheets

ICE BUCKET RETAINER FOR REFRIGERATOR

BACKGROUND OF THE INVENTION

The present invention relates generally to refrigerators and in particular to refrigerators with storage bins such as ice buckets.

Refrigerators are commonly equipped with shelves and storage bins for various food items, including ice. The shelves and storage bins may either be fixed in place, may be movable, such as slidable to extend out of the refrigeration compartment to allow a user to access the shelf or bin more readily, or the shelves and bins may be formed on the refrigerator door.

In U.S. Pat. No. 2,926,507, a storage bin for a refrigerator is mounted on pivotal arms and to the refrigerator door such that the bin will move out upon the opening of the refrigerator door, every time the door is opened. A second storage bin is provided that may be selectively slid or rolled out of the refrigeration compartment by the user after the door is opened.

In U.S. Pat. Nos. 5,899,083 and 6,447,083 refrigerators are disclosed having a number of fixed shelves and slidable storage bins which may be manually moved by a user after the door is opened. A slidable door, in the form of a drawer with a captured storage bin is also provided, with the bin moving out of the refrigeration compartment every time the door is opened. Fixed shelves and bins are also located in the pivoting doors of the refrigerators.

In U.S. Pat. No. 6,582,038, vertically movable storage bins are provided for attachment to the refrigerator door, and which move with the door each time it is opened.

In U.S. Pat. No. 6,745,578, an ice storage bin is carried by a slidable freezer drawer or basket. While it is stated that the freezer drawer may be selectively moved in and out of the refrigeration compartment, the means for effecting such movement is not described.

In the above described arrangements, the storage bins in a refrigerator are arranged such that either they move with the opening of the refrigerator door, each time the door is opened, or they remain stationary in the refrigeration compartment unless manually moved by the user after the door is opened.

It would be an improvement in the art if an arrangement were provided such that the user may select whether the storage basket will move automatically upon the opening of the refrigerator door, or will remain stationary in the refrigeration compartment unless manually moved by the user.

SUMMARY OF THE INVENTION

In an embodiment, a refrigerator is provided with a cabinet having a door that is openable by a user to provide access to a refrigeration compartment. A storage bin is located in the refrigeration compartment and is accessible upon the opening of the cabinet door. A mounting system for the storage bin is provided, supporting the storage bin for movement into and out of the refrigeration compartment. A latch is carried on the cabinet door to be selectively engaged by the user with a latch receiving portion of the storage bin. When the latch is engaged with the latch receiving portion, the storage bin will be retained by the cabinet door and will be pulled out of the refrigerator upon the opening of the cabinet door, and when the latch is disengaged from the latch receiving portion, the storage bin will remain in the refrigeration compartment, unless manually moved by the user.

In an embodiment, the present invention provides an ice bucket retainer system for use in a refrigerator with an openable door. The retainer system includes an ice bucket with a latch receiving portion, and a latch carried on the cabinet door to be selectively engaged by the user with the latch receiving portion of the ice bucket. When the latch is engaged with the latch receiving portion, the ice bucket will be pulled out of the refrigerator upon the opening of the cabinet door, and when the latch is disengaged from the latch receiving portion, the ice bucket will remain in the refrigeration compartment, unless manually moved by the user.

In an embodiment, the latch is slidable on the refrigerator door.

In an embodiment, the door is slidable relative to the refrigeration compartment.

In an embodiment, the ice bucket is slidable relative to the refrigeration compartment.

In an embodiment, the latch comprises a magnet and the latch receiving portion is a magnetic material.

In an embodiment, the latch is a mechanical catch.

In an embodiment, the latch is provided with a visual indication of its position.

In an embodiment, the latch is of a contrasting color to a remainder of the door.

In an embodiment, the latch receiving portion is carried on the ice bucket in a movable manner to accept latching engagement with the latch.

In an embodiment, the ice bucket includes a removable bucket portion.

In an embodiment, an ice bucket retainer system is provided for a refrigerator having a door that is openable by a user to provide access to a refrigeration compartment and an ice maker arranged to make, harvest and dispense ice. In this system, an ice bucket is located in an ice receiving position relative to the ice maker to receive ice dispensed from the ice maker, a mounting arrangement is provided for the ice bucket, supporting the ice bucket for movement into and out of the refrigerator, and a latch is carried on the refrigerator door to be selectively engaged by the user with a latch receiving portion of the ice bucket. When the latch is engaged with the latch receiving portion, the ice bucket will be pulled out of the refrigerator upon the opening of the refrigerator door, and when the latch is disengaged from the latch receiving portion, the ice bucket will remain in the refrigerator, unless manually moved by the user.

In an embodiment, the ice bucket is slidable on the mounting arrangement.

These and other aspects and details of the present invention will become apparent upon a reading of the detailed description and a review of the accompanying drawings. Specific embodiments of the present invention are described herein. The present invention is not intended to be limited to only these embodiments. Changes and modifications can be made to the described embodiments and yet fall within the scope of the present invention.

DETAILED DESCRIPTION OF THE PREFERRED EMBODIMENTS

Figure 1:
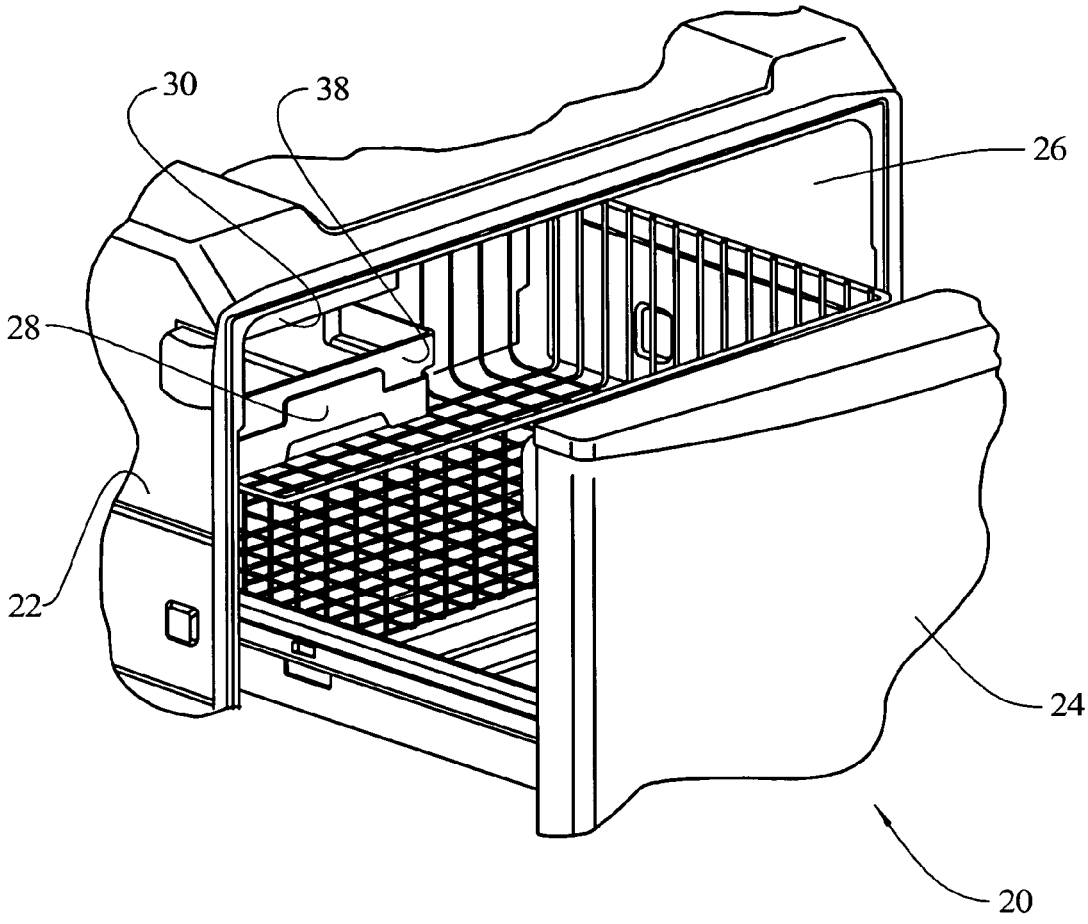
FIG. 1 is a partial front perspective view of a refrigerator with an open door.
Figure 2:
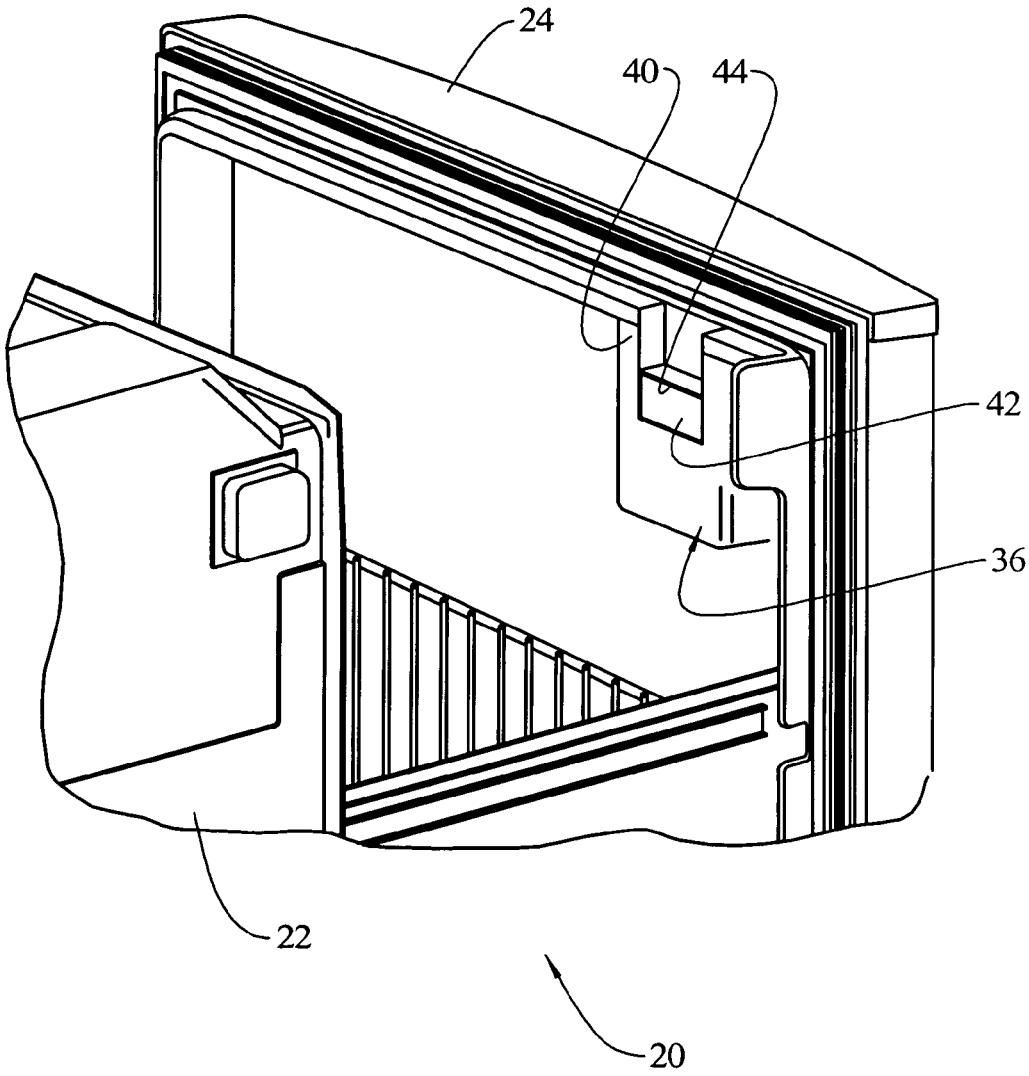
FIG. 2 is a partial rear perspective view of the opened refrigerator door of FIG. 1 with the latch in the disengaged position.
Figure 3:
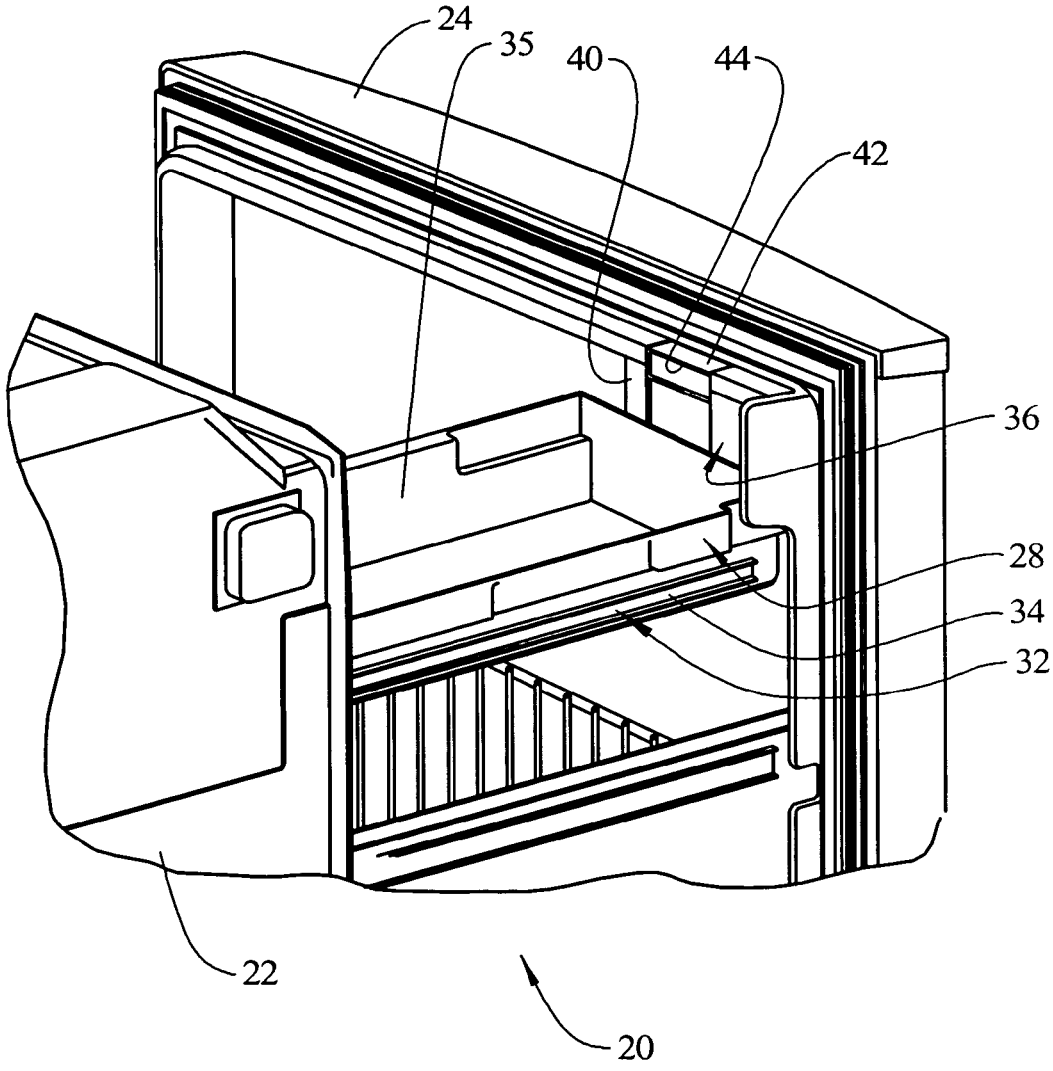
FIG. 3 is a partial rear perspective view of the opened refrigerator door of FIG. 1 with the latch in the engaged position.

In an embodiment of the invention, as illustrated in FIGS. 1-3, a refrigerator 20 is provided with a cabinet 22 having a door 24 that is openable by a user to provide access to a refrigeration compartment 26. The door 24 may be slidable relative to the cabinet 22 such as is common with a drawer, or may pivot to an open position. A storage bin 28 is located in the refrigeration compartment 26 and is accessible upon the opening of the door 24. The storage bin 28 may be used to store various types of food items in the refrigeration compartment 26, and in a particular embodiment, may be used to store ice made in an ice maker 30. The term "storage bin" is meant to include all types of support members within the refrigerator including shelves with or without vertically extending side walls or front walls, drawers, baskets, closed or open containers, rack, removable trays, containers or buckets and other known constructions for holding items within a refrigerator. The ice maker 30 may be located in the refrigeration compartment 26 and may be arranged to make, harvest and dispense ice. In this system, the storage bin 28 may include an ice bucket which is located in an ice receiving position relative to the ice maker 30 to receive ice dispensed from the ice maker.

A mounting system 32 (FIG. 3) may be provided for the storage bin 28 supporting the storage bin for movement into and out of the refrigeration compartment 26. For example, the storage bin 28 may be mounted on slides 34 which allow the storage bin to slide relative to the cabinet 22. The slides 34 may be formed on the interior of the refrigeration compartment or may be separate arms that are attached to the refrigerator door 24, particularly when the door slides open relative to the cabinet 22. The term "slide" is meant to include an arrangement where the mounting system 32 includes wheels or rollers and a rolling action occurs when the storage bin 28 is moved. The storage bin 28 may include a removable tray or bucket portion 35 which can separate from the storage bin. When the storage bin 28 is an ice bucket, the ice bucket may be an assemblage including a support portion which is movable relative to the refrigeration compartment, yet remains attached to the cabinet 22 and the removable bucket portion 35 which can be moved to a location remote from the cabinet.

A latch 36 is carried on the cabinet door 24 to be selectively engaged by the user with a latch receiving portion 38 provided on the storage bin 28 to retain the storage bin on the door. When the latch 36 is engaged with the latch receiving portion 38, the storage bin 28 will be pulled out of the refrigeration compartment 26 upon the opening of the cabinet door 24, and when the latch is disengaged from the latch receiving portion, the storage bin will remain in the refrigeration compartment, unless manually moved by the user. When the storage bin 28 includes the removable tray or bucket portion 35, the tray or bucket portion may be removed from the refrigerator 20 without disturbing the latch 36 and the latch receiving portion 32 of the storage bin.

Figure 4:
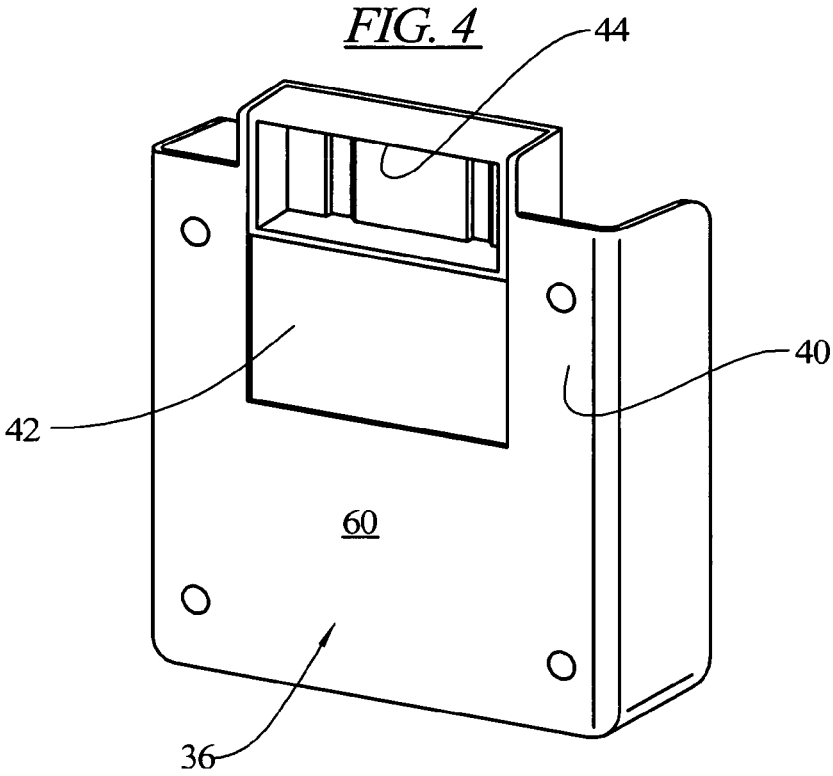
FIG. 4 is a front perspective view of the latch housing in isolation.
Figure 5:
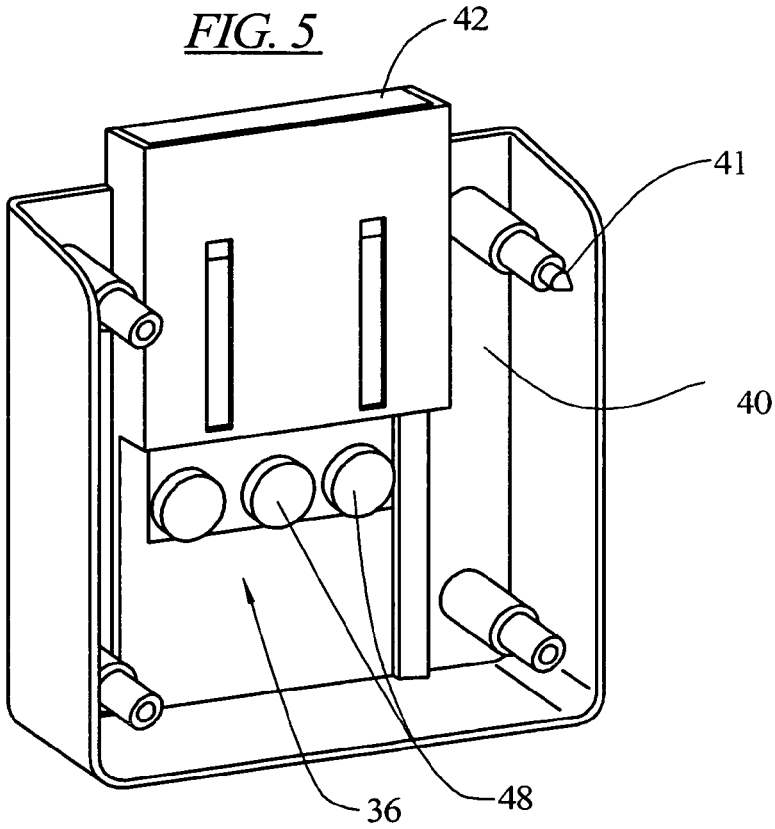
FIG. 5 is a rear perspective view of the latch housing of FIG. 4 in isolation.
Figure 6:
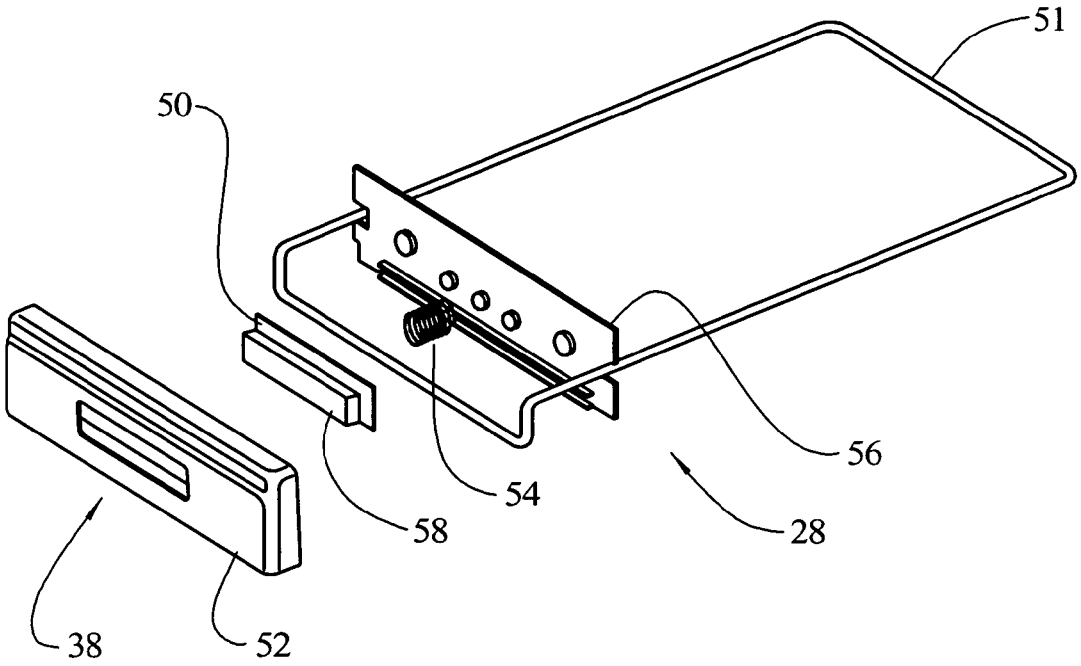
FIG. 6 is a side perspective exploded view of the latch receiving portion of the storage bin.
Figure 7:
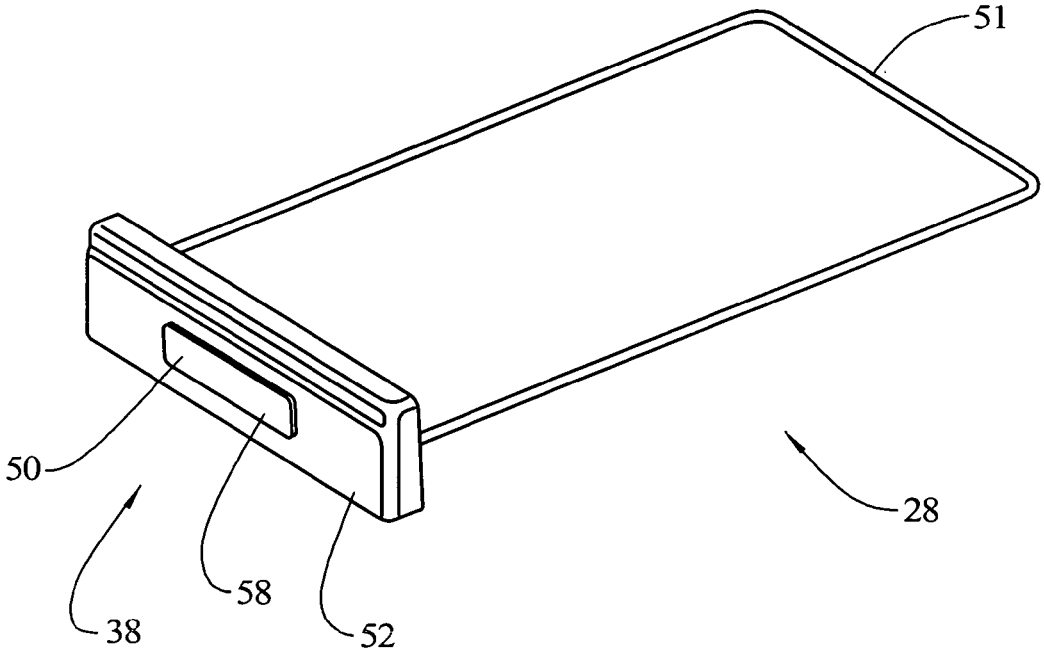
FIG. 7 is a side perspective assembled view of the latch receiving portion of the storage bin of FIG. 6.
Figure 8:
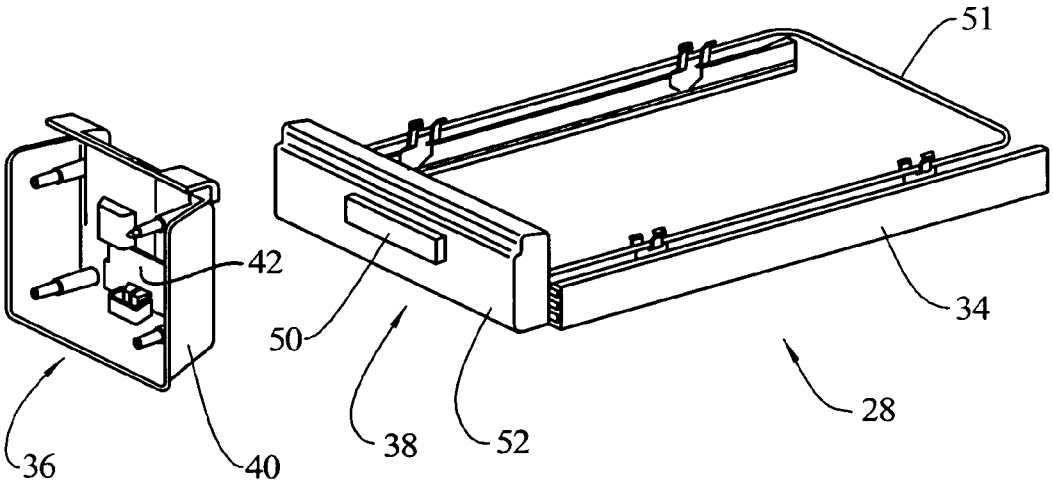
FIG. 8 is a side perspective assembled view of the latch receiving portion of the storage bin of FIG. 6.
Figure 9:
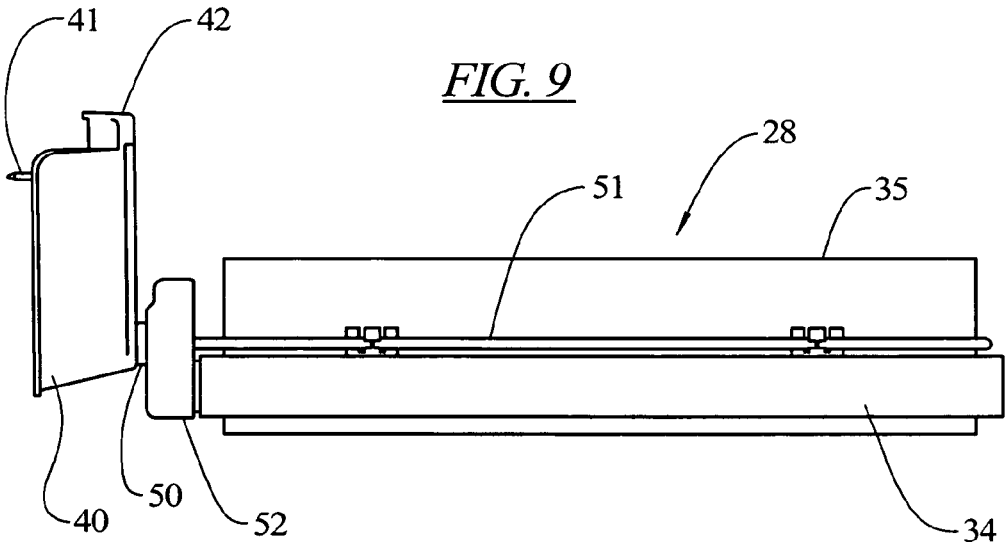
FIG. 9 is a side perspective assembled view of the latch receiving portion of the storage bin of FIG. 6.

The latch 36 may be mounted on the refrigerator door 24 in a slidable manner. For example, as shown in FIGS. 4 and 5, the latch may include a housing 40 that is mounted on the door 24, such as with threaded fasteners 41, with a vertically movable slide 42 that is provided with a manually engagable grip 44. The grip 44 allows a user to move the slide 42 up or down, as desired to cause the latch 36 to engage or disengage with the latch receiving portion 38 on the storage bin 28. The latch 36 may be integrated with a liner 46 of the door 24 so as to provide a uniform aesthetic appearance when the latch is in both the active and inactive positions.

The latch 36 and the latch receiving portion 38 may be arranged so that when the slide 42 is pulled to a vertically raised position, as shown in FIGS. 3-5, the latch and the latch receiving portion will engage and cause the storage bin 28 to move with the door 24, and when the slide is pushed to a vertically lowered position, as shown in FIG. 2, the latch and the latch receiving portion will disengage, and the storage bin will remain in the refrigeration compartment when the door is opened. The latch 36 may also be movably mounted on the door 24 in other fashions, such as a pivotal or rotatable mounting.

In an embodiment, the latch 36 may comprise one or more magnets 48 carried on the slide 42. The latch receiving portion 38 on the storage bin 28 may be a magnetically attractive material, such as a plate 50 (FIG. 6) made of iron, or other magnetic material, which is mounted in a relatively fixed position on the storage bin or a support 51 of the storage bin. While being relatively fixed, the plate 50 may be movable within a fixed range so that it is able to accommodate tolerances in the positioning of the door 24 and latch 36 relative to the storage bin 28. As shown in FIGS. 6-9, the plate 50 may be captured behind a frame 52 that is attached to the storage bin 28. The plate 50 may be biased into a projecting position relative to the frame 52 by one or more springs 54 positioned between the plate and a wall 56 of the storage bin 28 or support 51. The spring 54 allows the plate 50 to pivot or move within the frame 52 so that an exposed face 58 of the plate may be moved to be in a substantially parallel relationship with a face 60 of the latch housing 40 or the slide 42 to increase the magnetic attractive force between the magnets 48 and the plate. In other embodiments, the magnet 48 may be carried on the storage bin 28 and the magnetic material may be carried on the door 24. The use of magnets 48 as the latch retaining force allows the latch 36 to retain the storage bin 28 on the door 24 during normal operation of the refrigerator 20, but also allows for release between the door and the storage bin in conditions that are not normal, such as jams caused by ice or other objects that would not permit the storage bin to move with the door. Also, the use of magnets 48 allows for flush components, rather than projecting catch members, thereby eliminating the chance of objects being caught on the latch components.

Figure 10:
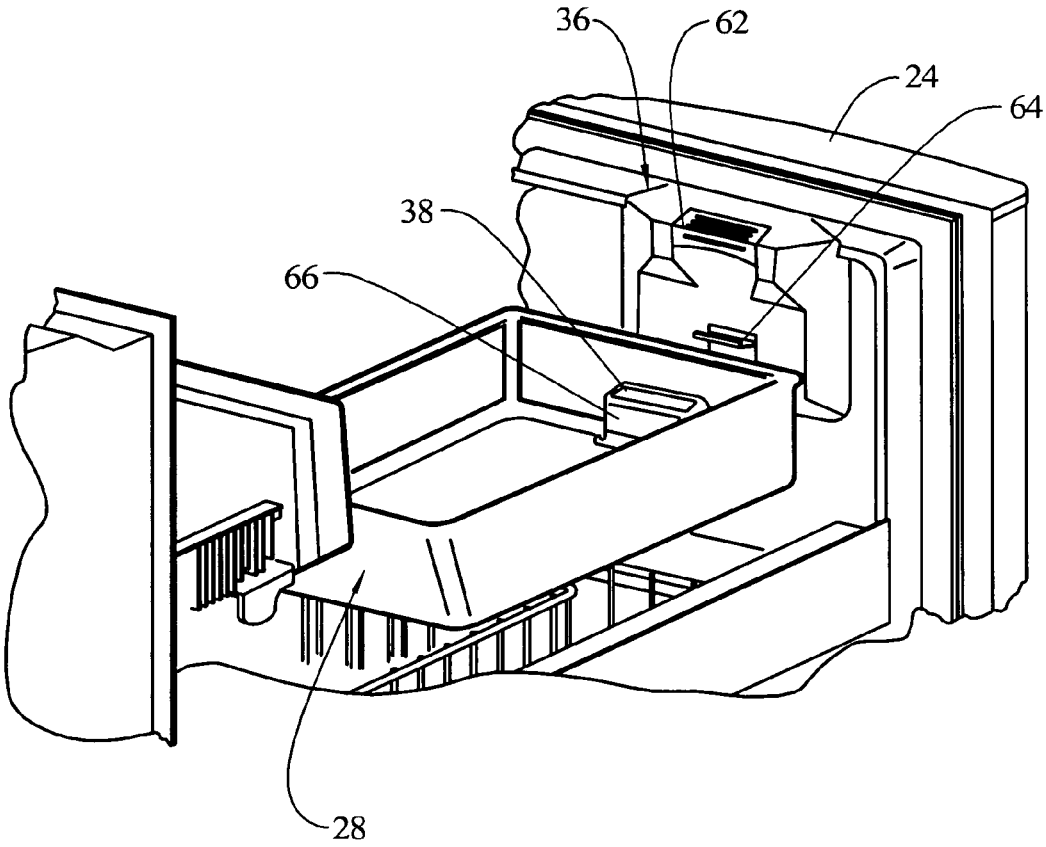
FIG. 10 is a partial rear perspective view of the opened refrigerator door of FIG. 1 with an alternative embodiment of the latch.

In another embodiment, as shown in FIG. 10, the latch 36 may be a mechanical catch. In such an embodiment, the latch 36 may also include a vertically movable slide 62 carrying a finger 64 which is interferingly engagable with a reciprocal component 66 on the storage bin 28 at the latch receiving portion 38, when the slide is in the raised position, and which avoids engagement with the latch receiving portion when the slide is in the lowered position.

The latch 36 may also take the form of selectively engaging pins, hooks, movable detents, or other known arrangements of providing a selective retaining connection between the door 24 and the storage bin 28, such that the user may select whether the storage bin will be moved automatically with the door or whether it will remain stationary in the refrigeration compartment 26 unless moved manually by the user. The particular type of latch utilized may depend on the particular application, storage bin weight, cost, distance between components and the location of various attachment points.

In an embodiment, the latch 36 is provided with a visual indication of its position which may include various indicia or a positional indication, such as being raised above the surrounding portion of the latch housing 40.

In an embodiment, the latch 36 is of a contrasting color to a remainder of the door 24 as a means of providing a visual indication of the latch position.

The present invention has been described utilizing particular embodiments. As will be evident to those skilled in the art, changes and modifications may be made to the disclosed embodiments and yet fall within the scope of the present invention. For example, various components could be utilized separately or independently in some embodiments without using all of the other components in the particular described embodiment. In other embodiments, different combinations of components than those combinations specifically shown and described could be used. The disclosed embodiments are provided only to illustrate aspects of the present invention and not in any way to limit the scope and coverage of the invention. The scope of the invention is therefore to be limited only by the appended claims.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The embodiments of the invention in which an exclusive property or privilege is claimed are defined as follows:

1. A storage receptacle retainer system for use in a refrigerator with a slidable door having a linear opening and closing movement, the door having a front face facing a direction of the opening movement, the storage receptacle retainer system comprising:

a first latch component carried on the slidable door, a movable storage receptacle having a second latch component engageable with the first latch component, the receptacle being located in a refrigeration compartment, at least one of the latch components being carried on a manually movable mechanical member selectively movable by the user in a plane parallel to the front face of the door between a first position wherein the first latch component is engaged with the second latch component causing the storage receptacle to be removed from the refrigerator compartment upon the sliding open of the door, and a second position wherein the first latch component is disengaged from the second latch component causing the storage receptacle to remain entirely within the refrigeration compartment upon the sliding open of the door, unless the storage receptacle is manually moved by the user, and a mounting arrangement for the movable storage receptacle which permits the storage receptacle to be capable of slidable movement into and out of the refrigeration compartment when the latch components are disengaged.

2. A storage receptacle retainer system according to claim 1, wherein said first latch component is slidable on said refrigerator door.

3. A storage receptacle retainer system according to claim 1, wherein said door is substantially horizontally slidable relative to said refrigeration compartment.

4. A storage receptacle retainer system according to claim 1, wherein said storage receptacle is substantially horizontally slidable relative to said refrigeration compartment.

5. A storage receptacle retainer system according to claim 1, wherein said first latch component comprises a magnet and said second latch component is a magnetic material.

6. A storage receptacle retainer system according to claim 1, wherein said first latch component is a mechanical catch.

7. A storage receptacle retainer system according to claim 1, wherein said first latch component is provided with a visual indication of the latch engagement position.

8. A storage receptacle retainer system according to claim 1, wherein said latch is of a contrasting color to a remainder of said door.

9. A storage receptacle retainer system according to claim 1, wherein said second latch component is carried on said storage receptacle in a movable manner to accept latching engagement with said first latch component.

10. A storage bin retainer system according to claim 1, wherein the refrigerator compartment further comprises a second storage receptacle positioned adjacent the movable storage receptacle.

11. An ice bucket retainer system for a refrigerator with a slidable door having a linear opening and closing movement that is openable by a user to provide access to a refrigeration compartment and an ice maker arranged to make, harvest and dispense ice, the ice bucket retainer system comprising:

an ice bucket located in a position relative to the ice maker to receive ice dispensed from the ice maker;

a mounting arrangement for the ice bucket, supporting the ice bucket for slidable movement into and out of the refrigeration compartment;

a mechanical slide including a latch carried on the slidable door, the slide having a manually graspable portion, which manually graspable portion is manually movable by the user between a first position relative to the slidable door in which the latch is engaged with a latch receiving portion of the ice bucket and a second translated position relative to the slidable door in which the latch is disengaged from the latch receiving portion, the mechanical slide being arranged so as to be movable relative to the slidable door while the slidable door is in an open position, whereby, when the latch is engaged with the latch receiving portion, the ice bucket will be removed from the refrigerator upon the sliding open of the refrigerator door, and when the latch is disengaged from the latch receiving portion, the ice bucket will remain entirely within the refrigerator upon the sliding open of the door, unless the ice bucket is manually moved by the user.

12. An ice bucket retainer system according to claim 11, wherein said ice bucket includes a removable bucket portion.

13. A storage bin retainer system according to claim 12, wherein the removable bucket portion can be lifted from the mounting arrangement.

14. A storage bin retainer system according to claim 11, wherein the refrigeration compartment is a freezer compartment.

15. A storage bin retainer system according to claim 11, wherein the refrigerator compartment further comprises a second storage receptacle positioned adjacent the ice bucket.

16. A refrigerator comprising:

a cabinet with a slidable door having a linear opening and closing movement that is openable by a user to provide access to a refrigeration compartment, the door having a first latch component;

a storage bin located in the refrigeration compartment and accessible upon the opening of the cabinet door, the storage bin including a second latch component engageable with the first latch component;

a mounting system for the storage bin, the mounting system supporting the storage bin for movement into and out of the refrigeration compartment;

a mechanical member carrying one of the latch components, the mechanical member being positioned wholly interior of an outside surface of the door and all parts of the mechanical member being accessible only when the door is in an open position and also being hidden from view when the door is in a closed position, the mechanical member having a manually graspable portion, which graspable portion is selectively movable by the user, via translation in a plane, relative to the other latch component, between a first position relative to the second latch component when the door is closed whereby the first latch component is engaged with the second latch component and causing the storage bin to be removed from the refrigerator upon the sliding open of the door, and a second position relative to the second latch component when the door is closed whereby the first latch component is disengaged from the second latch component and causing the storage bin to remain entirely within the refrigeration compartment upon the sliding open of the door, unless the storage bin is manually moved by the user.

17. A refrigerator according to claim 16, wherein said refrigerator further comprises an ice maker located in said refrigeration compartment and arranged to make, harvest and dispense ice, and said storage bin comprises an ice bucket located in an ice receiving position relative to said ice maker to receive ice dispensed from said ice maker.

18. A storage bin retainer system according to claim 17, wherein the refrigeration compartment is a freezer compartment.

19. A storage bin retainer system according to claim 17, wherein the refrigeration compartment further comprises a second storage bin positioned adjacent the ice bucket.

20. A refrigerator according to claim 16, wherein said first latch component is slidable on said refrigerator door.

21. A refrigerator according to claim 16, wherein said storage bin is slidable on said mounting arrangement.

22. A storage bin retainer system according to claim 21, wherein the storage bin can be removably lifted from the mounting arrangement.

23. A refrigerator according to claim 16, wherein said door is slidable relative to said refrigeration compartment.

24. A refrigerator according to claim 16, wherein said first latch component comprises a magnet and said second latch component is a magnetic material.

25. A refrigerator according to claim 16, wherein said first latch component is a mechanical catch.

26. A refrigerator according to claim 16, wherein said first latch component is provided with a visual indication of the latch engagement position.

27. A refrigerator according to claim 16, wherein said first latch component is of a contrasting color to a remainder of said door to enhance a visual indication of the latch engagement position.

28. A refrigerator according to claim 16, wherein said second latch component is carried on said storage bin in a movable manner to accept latching engagement with said first latch component.

* * * * *